US007337483B2

(12) United States Patent
Boucher et al.

(10) Patent No.: US 7,337,483 B2
(45) Date of Patent: Mar. 4, 2008

(54) SURGICAL POSITIONING APPARATUS

(75) Inventors: Michael Boucher, Ashburnham, MA (US); Kip Van Steenburg, Sudbury, MA (US); Paul J. Skavicus, Maynard, MA (US); David Warburton, Lexington, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 138 days.

(21) Appl. No.: 11/039,182

(22) Filed: Jan. 19, 2005

(65) Prior Publication Data

US 2005/0160533 A1 Jul. 28, 2005

Related U.S. Application Data

(60) Provisional application No. 60/538,671, filed on Jan. 23, 2004.

(51) Int. Cl.
*A61G 13/12* (2006.01)
*A61G 13/10* (2006.01)

(52) U.S. Cl. ..... 5/621; 5/623; 5/624; 5/646; 5/648

(58) Field of Classification Search ..... 5/621, 5/623, 624, 646, 647, 648, 649, 650, 651; 128/845
See application file for complete search history.

(56) References Cited

U.S. PATENT DOCUMENTS 2,267,924 A * 12/1941 Johnston ..... 602/39
2,609,261 A 9/1952 Parker
2,630,288 A * 3/1953 Eubanks, Sr. ..... 248/118
2,732,269 A * 1/1956 Astroff ..... 5/646
2,801,142 A * 7/1957 Adams ..... 5/646
3,540,719 A * 11/1970 Romney et al. ..... 5/647
4,054,282 A 10/1977 Hamer
4,163,536 A 8/1979 Heller et al.
4,564,180 A * 1/1986 Agee et al. ..... 269/75
4,579,324 A 4/1986 McConnell
4,702,465 A 10/1987 McConnell
4,730,609 A 3/1988 McConnell
4,782,827 A 11/1988 Paratte
4,809,687 A 3/1989 Allen
4,840,363 A 6/1989 McConnell
4,886,258 A 12/1989 Scott
4,909,264 A 3/1990 Wadsworth, III et al.
5,001,739 A 3/1991 Fischer
5,010,900 A 4/1991 Auchinleck et al.
5,291,903 A 3/1994 Reeves
5,410,769 A 5/1995 Waterman
5,462,551 A 10/1995 Bailey et al.
5,515,562 A 5/1996 Miller et al.
5,582,379 A 12/1996 Keselman et al.
5,645,079 A 7/1997 Zahiri et al.
5,758,374 A 6/1998 Ronci
5,802,641 A 9/1998 Van Steenburg
5,918,330 A 7/1999 Navarro et al.
6,058,534 A 5/2000 Navarro et al.
6,195,820 B1 3/2001 Heimbrock et al.

(Continued)

*Primary Examiner*—Alexander Grosz
(74) *Attorney, Agent, or Firm*—Barnes & Thornburg LLP

(57) ABSTRACT

A surgical positioning apparatus can be secured to a floor of an operating room or directly to an operating room table. The surgical positioning apparatus supports a limb of a patient using a telescoping strut mounted on a spherical joint. A disposable cradling device is coupled to the strut to secure the limb in position.

40 Claims, 10 Drawing Sheets

U.S. PATENT DOCUMENTS 6,263,531 B1 7/2001 Navarro et al.
6,336,412 B2 1/2002 Heimbrock et al.
6,467,487 B1 10/2002 Rios
6,629,944 B2 10/2003 Smart
6,663,055 B2 12/2003 Boucher et al.
6,811,541 B2 11/2004 Lambert
6,874,184 B2 * 4/2005 Chandler ..... 5/648

* cited by examiner

SURGICAL POSITIONING APPARATUS

CROSS REFERENCE TO RELATED APPLICATIONS

This application claims the benefit of U.S. Provisional Patent Application No. 60/538,671, filed on Jan. 23, 2004, and entitled LIMB POSITIONER.

BACKGROUND OF THE INVENTION

1) Field of the Invention

The invention relates to a support for a limb, and more particularly to a support used to position and hold patient limbs during surgical procedures.

2) Description of Prior Art

Many surgical procedures require that a patient's limb or limbs be positioned in a number of different positions for the performance of the surgical procedure. It is desirable that the operating surgeon or surgical assistant be able to move the limb into other positions and configurations that may be required during the course of the surgical procedure. It is also desirable that any positioning apparatus that may be used to achieve such positions and configurations mitigate unwanted stress on the operative joint.

One conventional method for positioning a body part is to have a sterile surgical assistant hold the body part in a desired position, and change the position when and as requested by the operating surgeon. This task is fatiguing for the surgical assistant, and this technique may not support the patient's body part in a sufficiently precise and rigid manner for the surgical procedure. Other conventional methods for positioning a patient's limb are to rest the limb on a table for that purpose, to hang the limb over part of the operating room table, or to rest the limb on the lap of a seated operating surgeon. All such techniques offer a very limited range of possible limb configurations, serve to restrict the movement of the surgeon, and result in reduced precision and rigidity of support.

Further, conventional devices that are employed for supporting a patient's limb during a surgical procedure are typically unable to support the limb while at the same time allowing the limb to be manipulated in one or more axes. Such devices can typically only be fully locked or fully unlocked, and are not able to support their own weight when unlocked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a surgical positioning apparatus includes: a docking member adapted to be placed under one or more feet of an operating room table such that a weight of the operating room table secures the docking member to a floor; and a base for a surgical positioning apparatus secured to the docking plate.

In accordance with another aspect of the present invention, a surgical positioning apparatus includes: a telescoping strut operable to support a limb of a patient; and a base coupled to the telescoping strut via a pivotable coupling, wherein the telescoping strut provides support for the patient's limb in a vertical direction, and wherein the pivotable coupling allows movement of the patient's limb in a horizontal plane.

In accordance with yet another aspect of the present invention, a surgical positioning apparatus includes: a strut; a universal joint coupled to a top portion of the strut; and a limb cradle coupled to the universal joint to support a limb of a patient.

In accordance with yet another aspect of the present invention, a surgical positioning apparatus includes: a strut; and a disposable limb cradle coupled to the strut via a latching mechanism, wherein the latching mechanism includes a fixed prong and two moveable prongs so that the disposable limb cradle can be replaced without breaking a sterile field in an operating room.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
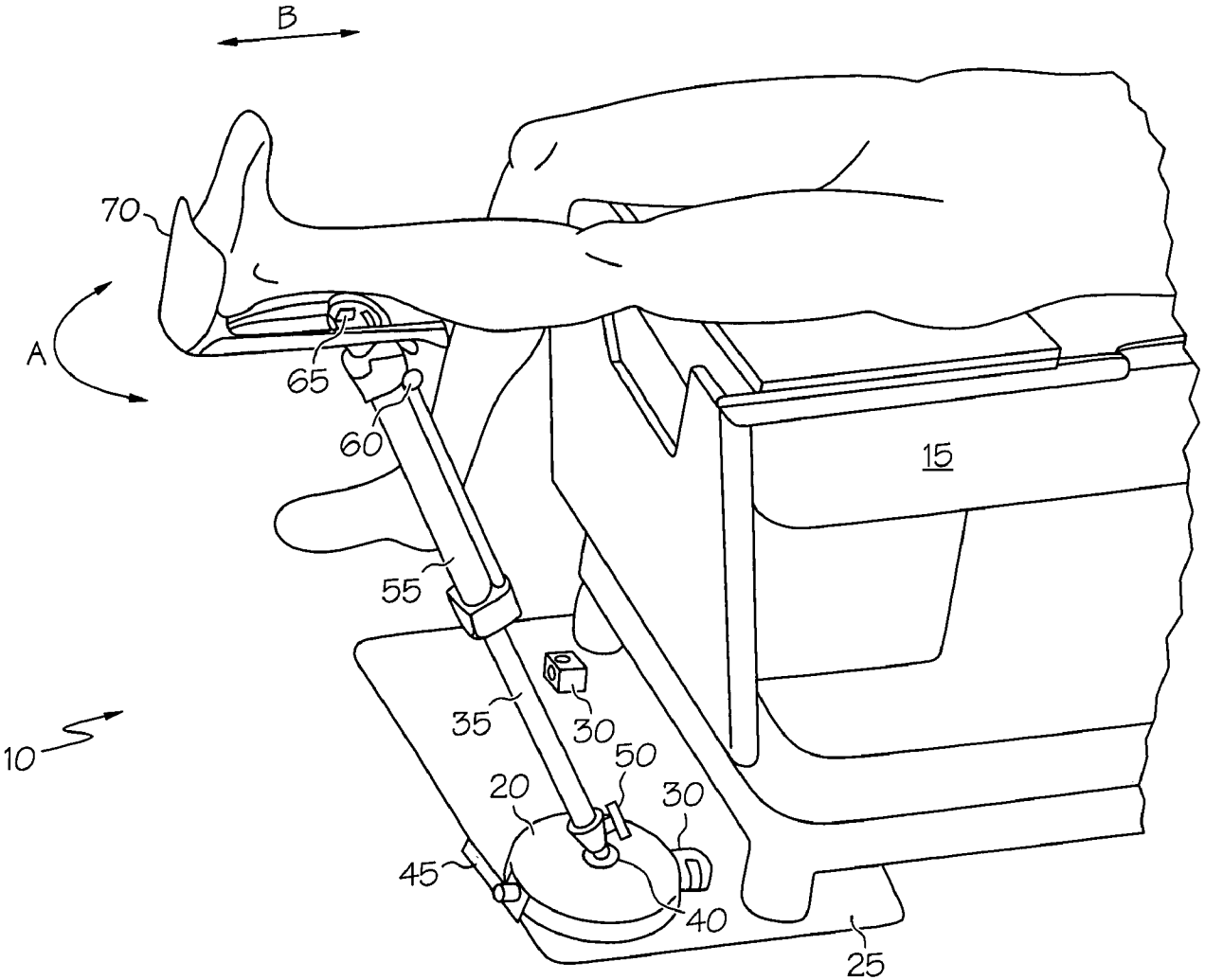
FIG. 1 illustrates an example of a surgical positioning apparatus in accordance with an aspect of the present invention.

The present invention provides an apparatus for positioning a patient's limb during a surgical procedure. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Referring initially to FIG. 1, an example of a surgical positioning apparatus 10 is depicted in accordance with an aspect of the present invention. The surgical positioning apparatus 10 can be located near a portion of an operating room table 15 (e.g., a foot portion), such that the surgical positioning apparatus 10 is able to support a patient's limb (e.g., leg) in an extended position. The surgical positioning apparatus 10 comprises a base 20, which can be secured to a docking member 25. The docking member 25 can be manufactured from metal, plastic, or any other suitable material, and can be in the form of a sheet for placing under one or more feet of the operating room table 15. The weight of the operating room table 15 works to secure the docking member 25 and thus, the base 20 to the floor. A latch mechanism 30 can be employed to secure the base 20 to the docking member 25. The latch mechanism 30 can be of any suitable latch that provides an easy coupling and release of the base 20 to and from the docking member 25. It is to be appreciated that there can be more than one latch mechanism 30 on the docking member 25. For example, as illustrated in FIG. 1, the docking member 25 can include two latch mechanisms 30, each for securing a respective surgical positioning apparatus thereto (although only one surgical positioning apparatus is shown in FIG. 1 for ease of illustration). Alternatively, the latch mechanism 30 can be secured directly to the floor for securing the base 20 of the surgical positioning apparatus thereto.

As yet another alternative, the base 20 can be secured to the floor or the docking member 25 via one or more suction cups (not shown) positioned at a bottom portion of the base 20. Accordingly, it is to be appreciated that the base 20 can be secured in place with respect to a location of the operating room table 15 via any suitable structure and is contemplated as falling within the scope of the present invention. The base 20 is employed to provide stability to the surgical positioning apparatus 10 such that when the base 20 is not securely coupled to another structure, the surgical positioning apparatus 10 maintains an upright position.

Further, it is to be appreciated that the docking member and base assembly can be employed to support a variety of other surgical support and/or positioning apparatus. Further, the docking member and base assembly can be positioned at a side of the operating room table 15 to support a patient's arm during a surgical procedure or any other procedure that would require support of a limb.

The surgical positioning apparatus 10 also includes a strut 35, which is coupled to the base 20 via a suitable pivotable coupling 40. For instance, the pivotable coupling 40 can include a locking spherical joint, or any other suitable coupling that facilitates pivoting of the strut 35 with respect to the base 20 and includes a locking mechanism to hold the strut 35 and base 20 in a desirable position. For instance, when the pivotable coupling 40 is in an unlocked state, the limb is able to swing freely in a side-to-side manner along a horizontal plane, as indicated by arrow A. Optionally, the pivotable coupling 40 can also be selectively unlocked to move the surgical positioning apparatus 10 in a fore and aft manner, as indicated by arrow B. Further, the strut 35 can be pivotally coupled to any other contemplated structure. For instance, the strut 35 can be pivotally coupled to an arm member (not shown) that is operatively coupled to the operating room table 15 or some other structure. A locking member 45 for the pivotable coupling can be operatively coupled to the pivotable coupling 40 to provide an easily accessible means for locking and unlocking of the pivotable coupling 40. For instance the locking member 45 for the pivotable coupling can be a foot pedal; however, it is to be appreciated that any suitable locking mechanism can be employed with the pivotable coupling 40 to lock the strut 35 in a desired position along a horizontal plane.

The surgical positioning apparatus 10 further includes a height adjustment mechanism 50 to provide vertical adjustability for the surgical positioning apparatus 10 during set up of the apparatus 10. In particular, the height of the surgical positioning apparatus 10 apparatus can be adjusted to correspond with various operating room table heights or patient sizes and positions. The height adjustment mechanism 50 can be a manual device located near the base 20 or any other suitable device.

To provide further adjustability for the surgical positioning apparatus 10, the strut 35 can be a telescoping strut. The telescoping strut 35 includes a slidable member 55 that is moveable between a lowered position, in which the slidable member 55 envelopes a lower member, and a raised position, in which the lower member extends from the slidable member 55. Of course, the telescoping strut 35 can have any number of telescoping components and is contemplated as falling within the scope of the present invention.

The telescoping strut 35 has suitable structure to secure the strut 35 into one of a plurality of telescoped lengths. As such, the telescoping strut 35 is operable to support a limb of a patient while in a secured position and yet permit the limb to flex naturally at its joint when the telescoping strut 35 is allowed to extend or retract. A locking mechanism 60 is operably coupled to the slidable member 55 such that the telescoping strut 35 can be selectively locked in a variety of different telescoped lengths. When locking mechanism 60 is in an unlocked state, compressing the telescoping strut 35 can lower the limb and extending the telescoping strut 35 can raise the limb. In other words, the limb can be lowered and raised by sliding the slidable member 55 in a downward and upward manner, respectively, along the lower member. Locking mechanism 60 can be a locking knob or any other suitable device for locking the slidable member 55. Further, the telescoping strut 35 can be locked and unlocked independently of the pivotable coupling 40, thereby allowing the limb to be held securely in one axis while allowing free motion in the other. The telescoping strut 35 can optionally include one or more springs or other stored energy devices (not shown) located within the strut 35 to provide lifting assistance for the limb. Alternatively, the telescoping strut 35 can be hydraulically actuated.

Due to the adjustability of the surgical positioning apparatus 10 in at least two, and preferably, three axes, the present invention provides support for the weight of a limb without inducing unwanted joint stress. In particular, the present invention provides support for the weight of the limb while at the same time allowing a surgeon to freely manipulate the limb in other axes, thereby providing a range of motion of the limb required by the surgeon to efficiently perform the surgery. For instance, the surgical positioning apparatus can support the limb in a vertical direction, while allowing free motion in a horizontal plane during the surgical procedure.

Figure 2:
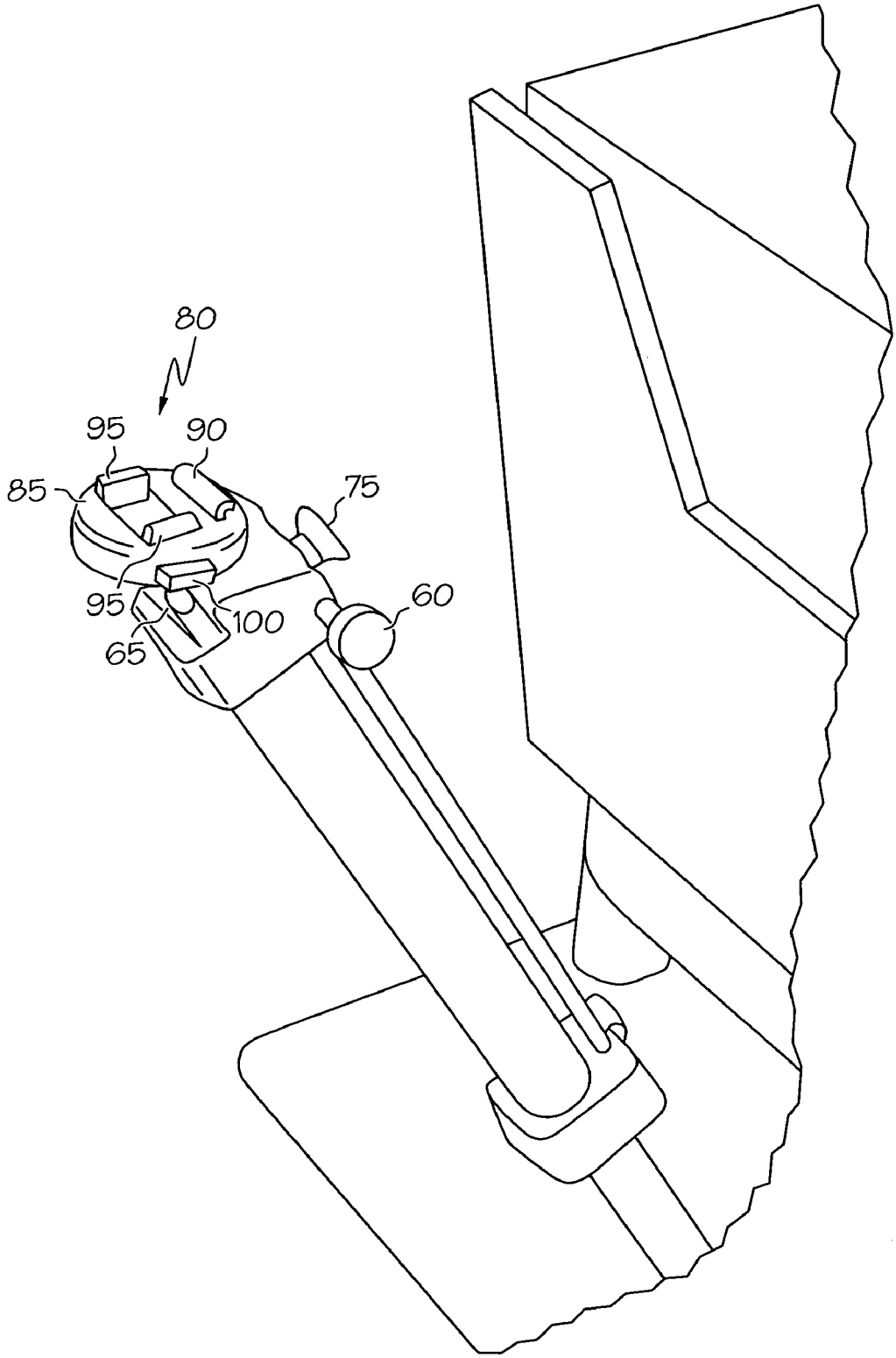
FIG. 2 illustrates an example of a joint for a surgical positioning apparatus in accordance with an aspect of the present invention.

A universal joint 65 is operatively coupled between the telescoping strut 35 and a limb cradle 70, which is employed to hold the limb in a surgical position. The universal joint 65 provides a large angular variation of support for the limb in the limb cradle 70. For instance, the universal joint 65 allows a limb (e.g., a leg) to be placed and held securely in a surgical position commonly known as a "Figure Four" position. Turning now to FIG. 2, the universal joint 65 is illustrated in further detail in accordance with an aspect of the present invention. The universal joint 65 is coupled to a top portion of the slidable member 55 of the telescoping strut 35 and optionally includes a locking mechanism 75, which engages the slidable member 55 to lock the universal joint 65 in a side-to-side direction. The locking mechanism 75 can be a locking knob; however, it is to be appreciated that the universal joint 65 can be coupled to the slidable member in any suitable manner.

The universal joint 65 further includes a latching mechanism 80. The latching mechanism 80 comprises a body 85 having one fixed prong 90 and two moveable prongs 95 thereon. The prongs 90, 95 are engageable with the limb cradle 70, as will be discussed in further detail below. The fixed prong 90 is positioned near a first edge portion of the body 85; and the two moveable prongs 95 are positioned near second and third edge portions of the body 85. For example, the moveable prongs 95 can be positioned substantially parallel with respect to each other and located at opposed portions of the body 85, while the fixed prong 90 can be positioned on the body 85 substantially perpendicular with respect to the moveable prongs 95.

The universal joint 65 further includes at least one release mechanism 100 to move the two moveable prongs 95 to a disengaged position. When the moveable prongs 95 are moved to the disengaged position, the limb cradle 70 can be released from the universal joint 65. For example, there can be two release mechanisms 100, each corresponding with a respective moveable prong 95. It is noted that only one release mechanism is depicted in FIG. 2. The other of the two release mechanisms is positioned on a side of the body 85 opposite to the visible release mechanism 100. The release mechanism(s) 100 functions to move the moveable prongs 95 in a position that disengages the moveable prongs 95 from the limb cradle 70. For instance, the moveable prongs 95 can be normally biased outward and the release mechanism(s) 100, when actuated, can function to move the moveable prongs 95 inward. Alternatively, the moveable prongs 95 can have an inward bias and the release mechanism(s) 100 can operate to move the moveable prongs 95 outward.

It is to be appreciated that the above-described configuration of prongs is just an example of a latching mechanism that can be employed with the present invention; and the fixed and moveable prongs described herein can be of any number and any configuration and can be positioned at any suitable location on the body 85 to suitably couple the limb cradle 70 to the universal joint 65.

Figure 3:
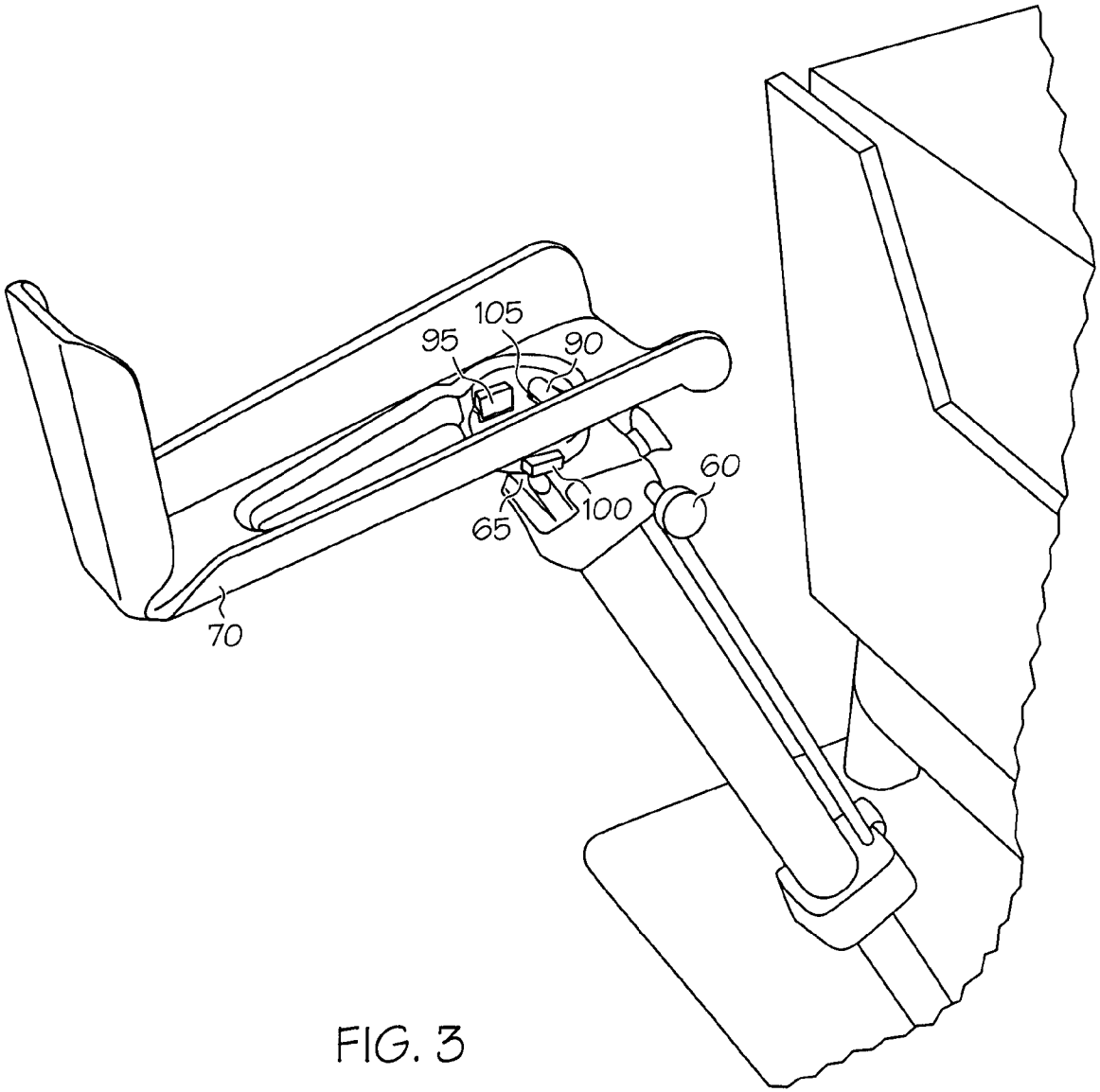
FIG. 3 illustrates an example of a limb cradle for a surgical positioning apparatus in accordance with an aspect of the present invention.

FIG. 3 illustrates an example of the coupling between the universal joint 65 and the limb cradle 70 in accordance with an aspect of the present invention. The limb cradle 70 is a sterile disposable limb cradle. Thus, it is possible that a used limb cradle can be easily removed and replaced with a new limb cradle without breaking a sterile field. The limb cradle 70 includes first, second, and third slotted apertures 105 for receiving the fixed prong 90 and two moveable prongs 95 therethrough. The limb cradle 70 is coupled to the universal joint 65 by first engaging a corresponding slotted aperture 105 to the fixed prong 90 and then engaging the moveable prongs 95 with corresponding slotted apertures 105 without activating the release mechanism(s) 100. The fixed prong 90 and moveable prongs 95 can include sloped lead-ins to facilitate easier engagement of the slotted apertures 105 of limb cradle 70 with the prongs 90, 95. Once, the prongs 90, 95 are engaged with the slotted apertures 105, the moveable prongs 95 are biased outward to maintain engagement with the limb cradle 70. To remove the limb cradle 70, the release mechanism(s) 100 is depressed, thereby moving the moveable prongs 95 inward, which in turn, releases the limb cradle 70, allowing it to be discarded. Accordingly, the disposable limb cradle 70 can be quickly attached to and detached from the surgical positioning apparatus 10 without breaking the sterile field.

The surgical positioning apparatus 10 of the present invention, as described herein, provides a single point telescoping support of the limb. This single point mount forms a triangle with the operative limb, with the pivotable coupling 40, the universal joint 65 and the patient's limb joint forming the three vertices of the triangle. Supporting the limb in this way allows the limb to flex naturally at the joint when the telescoping strut is released and allowed to extend and retract. Further, the limb may be swung freely side-to-side by the surgeon when the pivotable coupling 40 is unlocked. The limb can also be locked in place by one or more of the controls (e.g., pivotable coupling locking mechanism 45, telescopic strut locking mechanism 60, and universal joint locking mechanism 75) provided by the surgical positioning apparatus 10.

Figure 4:
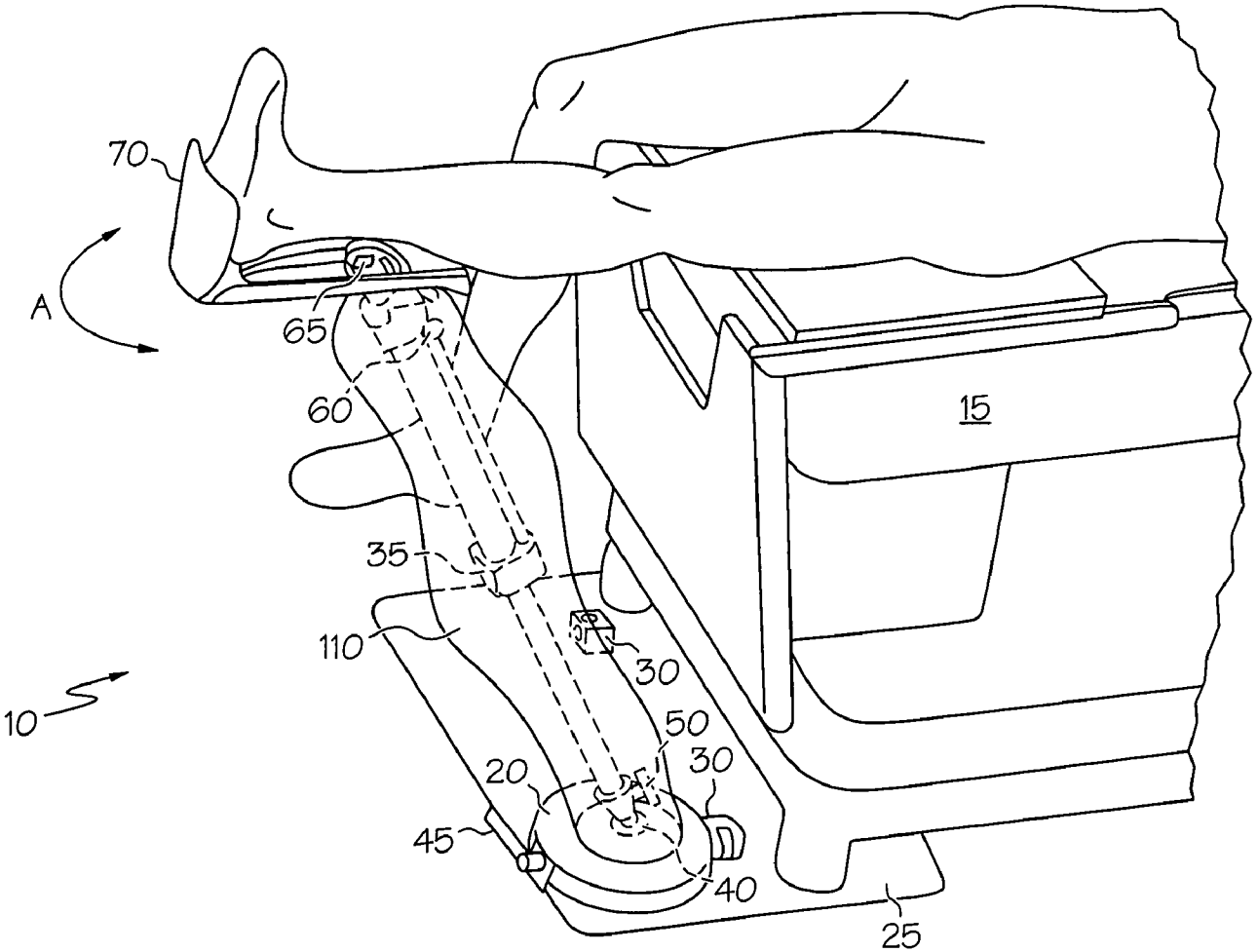
FIG. 4 illustrates a surgical positioning apparatus having a drape in accordance with an aspect of the present invention.

As depicted in FIG. 4, sterility of the surgical positioning apparatus 10 can be maintained by a protective drape 110 coupled to the sterile disposable limb cradle 70. The protective drape 110 is employed to protect the surgical positioning apparatus from an operating room environment. Alternatively, the drape 110 can be coupled to the universal joint 65, the strut 35, or any other suitable structure. The drape 110 can include a geometry that allows access to the controls (e.g., pivotable coupling locking mechanism 45, telescopic strut locking mechanism 60, and universal joint locking mechanism 75) of the surgical positioning apparatus 10 while the surgical positioning apparatus 10 is protected by the drape 110.

Figure 5:
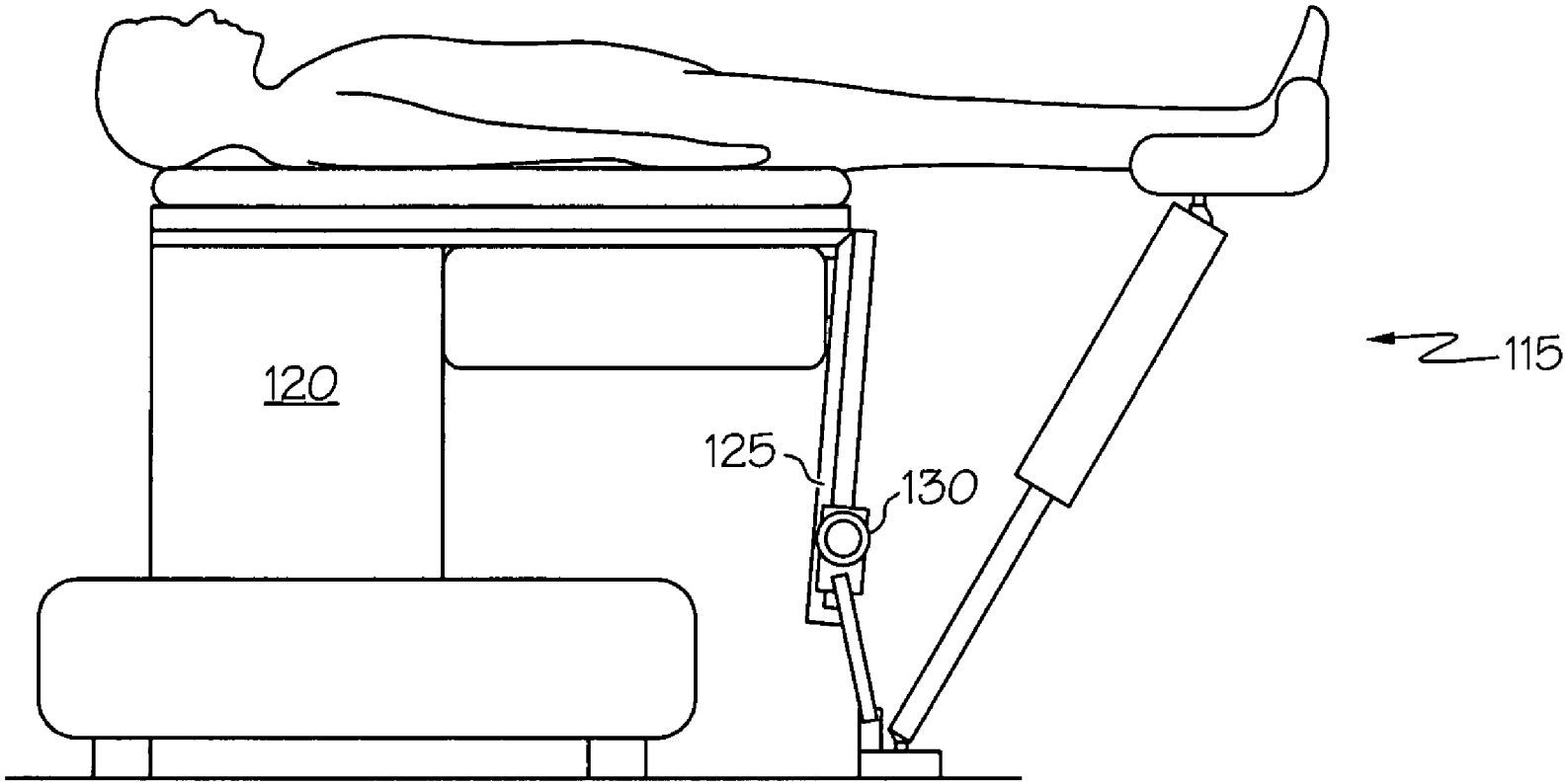
FIG. 5 illustrates a surgical positioning apparatus mounted to a foot section of an operating room table in accordance with an aspect of the present invention.

FIG. 5 illustrates an alternative version of a surgical positioning apparatus 115 that can be secured to an operating room table 120. In the depicted example, the surgical positioning apparatus 115 is clamped, or otherwise secured, to a foot section 125 of the operating room table 120. However, it is to be appreciated that the surgical positioning apparatus 115 can be secured to any suitable portion of the operating room table 120. For example, the surgical positioning apparatus 115 can be clamped to a rail of the operating room table 120 via a rail clamp 130.

Figure 6:
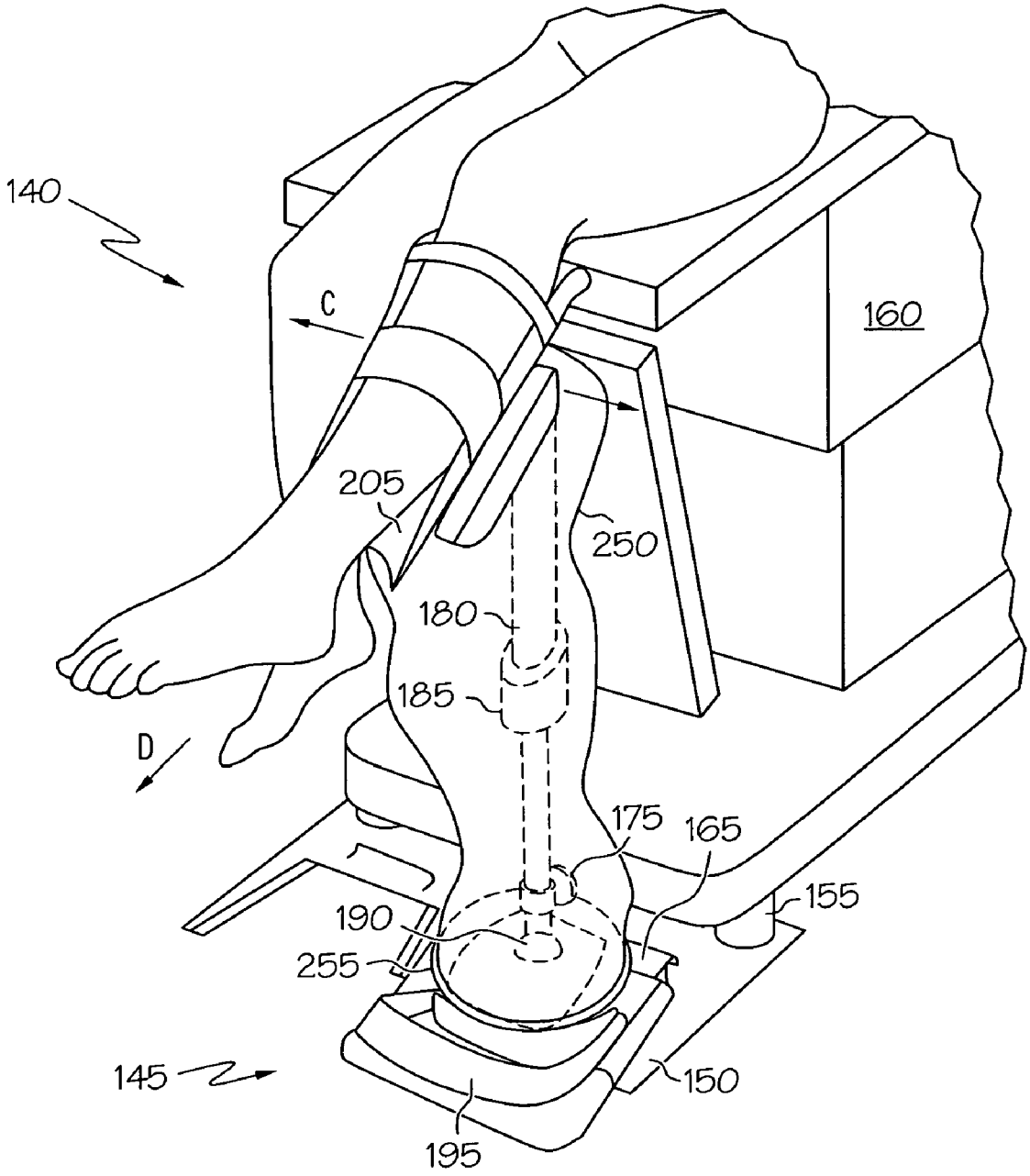
FIG. 6 illustrates another example of a surgical positioning apparatus in accordance with an aspect of the present invention.
Figure 7:
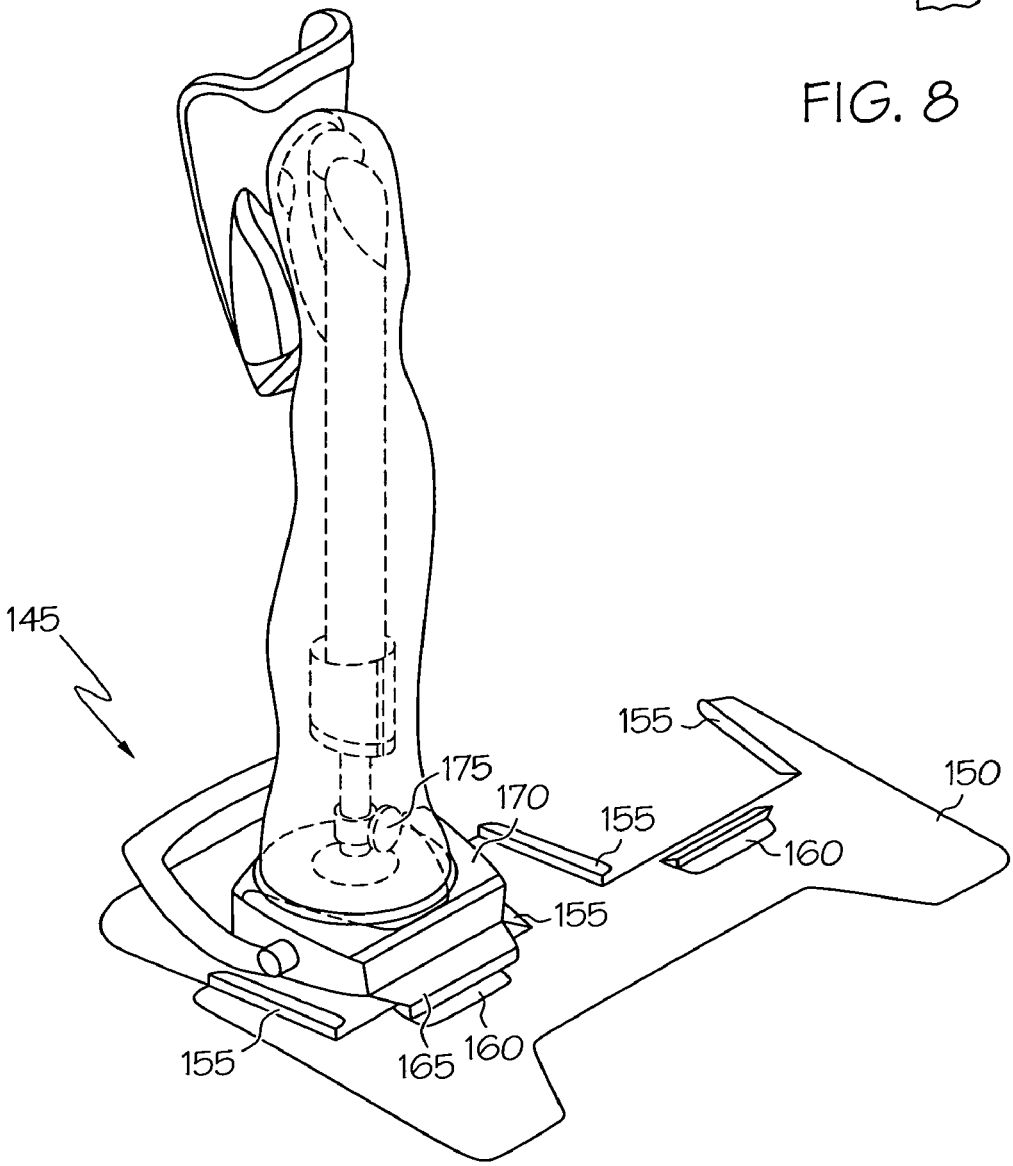
FIG. 7 illustrates an example of a base operable to support a surgical positioning apparatus in accordance with an aspect of the present invention.

Turning now to FIG. 6, another example of a surgical positioning apparatus 140 is illustrated in accordance with an aspect of the present invention. The surgical positioning apparatus 140 includes a base 145 secured to a docking member 150. The docking member 150 can comprise a plate manufactured from thin sheet metal, plastic, or the like and can be secured in place by one or more feet 155 of an operating table 160. FIG. 7 depicts an example of a coupling between the base 145 and the docking member 150. The docking member 150 includes a cut out portion for receiving the base 145 with guides 155 positioned along each side of the cut out portion. The guides 155 have a channel shaped opening and are adapted to slidably receive corresponding sides of the base 145, thereby facilitating alignment of the base 145 with the docking member 150. The docking member further includes a tab 160 at a rearward position of the cut out portion. The tab 160 can have a substantially inclined front portion and substantially vertical back portion. Accordingly, a latch 165 located on the base is able to "ride up" the inclined portion of the tab 160 and latch onto the vertical back portion to lock the base 145 into place with respect to the docking member 150. The base 145 can be unlocked from the docking member 150 via a foot pedal 170, which is adapted to disengage the latch 165 from the tab 160 by raising the latch 165 upwards. It is to be appreciated that any other suitable mechanism for securing the base 145 to the docking member 150 can be employed.

Alternatively, the base can be secured directly to the floor via a suitable fastener, such as one or more suction cups (not shown). Moreover, any suitable base configuration or base and docking member coupling can be employed to position the surgical positioning apparatus 140 in place with respect to the operating table.

Turning back to FIG. 6, the surgical positioning apparatus 140 further includes a telescoping strut 180 to provide support of the patient's limb. The telescoping strut 180 includes a manual height adjustment 175 coupled thereto for facilitating adjustment of the positioning apparatus 140 with respect to various table heights and/or patient positions. The telescoping strut 180 comprises a first joint 185 that can be operated pneumatically, hydraulically, elastomerically, with springs, or any other suitable manner to provide a vertically adjustable support for the limb. A first locking member 210 (FIG. 8) for selectively locking and unlocking the first joint 185 can be a hand control located beneath a limb cradle 205 to allow easy access for the surgeon. When the telescoping strut 180 is in an unlocked state, a limb positioned on the limb cradle 205 can be lowered by compressing the strut 180 or raised by extending the strut 180 about the first joint 185. Optionally, stored energy devices can be provided within the strut 180 to provide lifting assistance for the limb. It is to be appreciated that the surgical positioning apparatus 140 can be alternatively provided with a non-telescoping strut if desired.

A first end of the telescoping strut 180 is coupled to the base 145 via a second joint 190, such as a locking spherical joint. The second joint 190 can be mechanically, pneumatically, or electrically operated and can be locked and unlocked via a second locking member 195, such as a foot pedal or any other suitable device. The second joint 190 is adapted to allow the strut 180 to move freely in a side-to-side and fore and aft manner, as indicated by arrows C and D, respectively, while still providing support of the limb in a vertical direction. Further, the second joint 190 can be selectively locked and unlocked to only allow movement in a side-to-side manner or only in a fore and aft manner or both. Further, because the first joint 185 and the second joint 190 are operated (e.g., locked and unlocked) independently of each other, the apparatus 140 can securely support the limb in one axis while allowing free movement of the limb in another axis.

Figure 8:
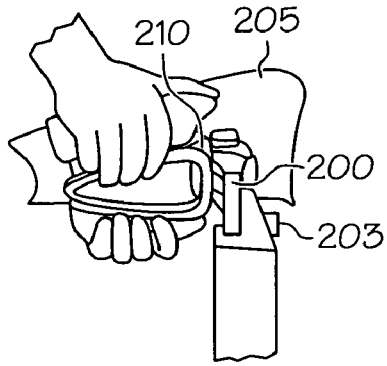
FIG. 8 illustrates an example of a joint between a strut and a limb cradle of a surgical positioning apparatus in accordance with an aspect of the present invention.

FIG. 8 depicts a third joint 200 for the surgical positioning apparatus 140 in accordance with an aspect of the present invention. The third joint 200 can be located on, or adjacent, a second end of the telescoping strut 180 to facilitate support and movement of the limb cradle 205 with respect to the strut 180. Preferably, the third joint 200 is a universal joint; however, it is to be appreciated that any suitable joint can be utilized to couple the strut 180 and the limb cradle 205. A third locking member 203 is also provided on the surgical positioning apparatus 140 to selectively lock and unlock in the third joint 200 in various positions and various axes. For instance, the third joint 200 can move freely in a front to back manner while being locked in a side-to-side manner via the third locking member 203. Locking the third joint 200 from moving in a side-to-side direction mitigates the limb from twisting during a surgical procedure.

Figure 9:
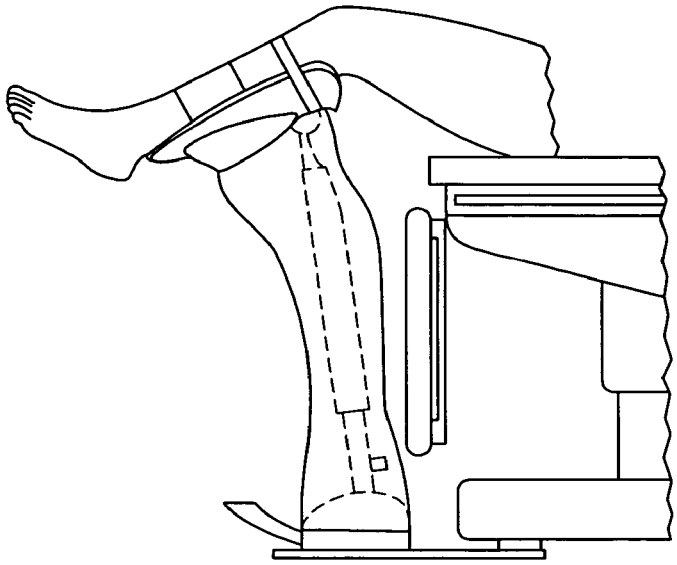
FIG. 9 illustrates a surgical positioning apparatus in a first position in accordance with an aspect of the present invention.
Figure 10:
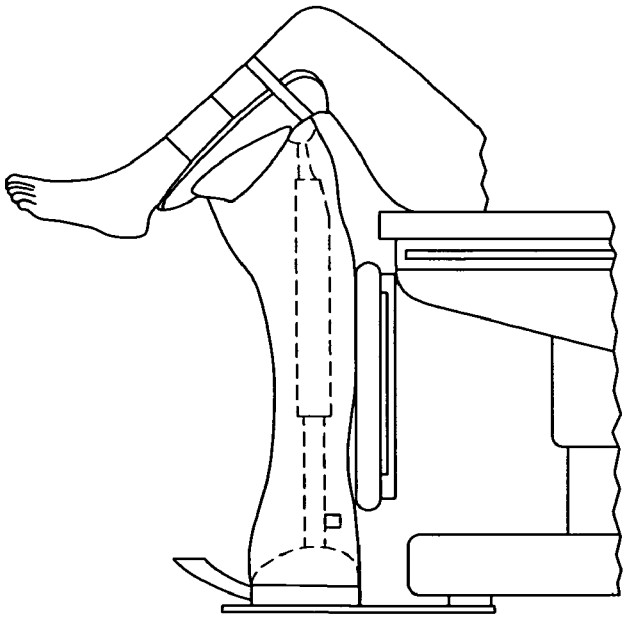
FIG. 10 illustrates a surgical positioning apparatus in a second position in accordance with an aspect of the present invention.

As illustrated in FIGS. 9 and 10, the combination of the second and third joints 190 and 200 allows a knee joint to flex in a natural motion from 0° to more than 90°. The positioning apparatus 140 provides a single point telescoping support of the limb. The single point mount forms a triangle with the operative limb, with the second joint 190, the third joint 200, and the patient's limb joint forming the three vertices of the triangle. Supporting the limb in this unique way allows the limb to flex naturally at the joint when the telescoping strut 180 is released and allowed to extend and retract, as shown in FIGS. 9 and 10. Further, the limb can be moved freely in a side-to-side manner by the surgeon when the first joint 185 is locked and the second joint 190 is unlocked. Further, locking all controls provided by the device can operate to lock the limb rigidly in place.

Figure 11:
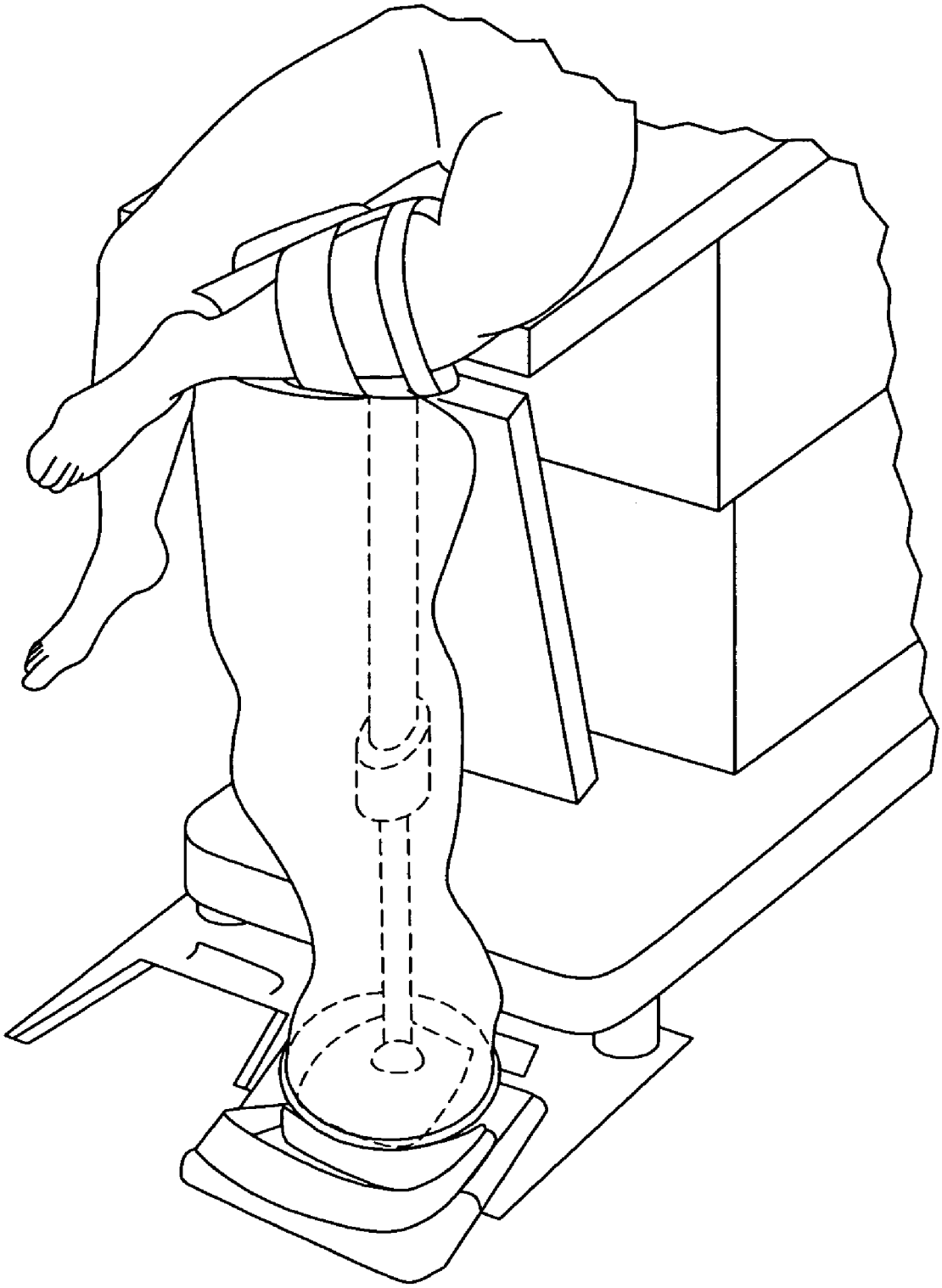
FIG. 11 illustrates a surgical positioning apparatus in a third position in accordance with an aspect of the present invention.

Turning back to FIG. 8, the third locking member 203 can be an unlocking button that releases the third joint 200 in the side-to-side axis. Accordingly, when the unlocking button is released, the third joint 200 can be twisted in a controlled fashion so that the operative limb can be positioned in a "Figure Four" position, as depicted in FIG. 11. The third locking member 203 can automatically "re-lock" when the joint is returned to an upright position. Further, the third locking member 203 is operable to lock the third joint 200 in any suitable position. The third joint 200 can be locked in multiple positions (e.g., in only one degree of freedom, in multiple degrees freedom) or can be unlocked completely.

Figure 12:
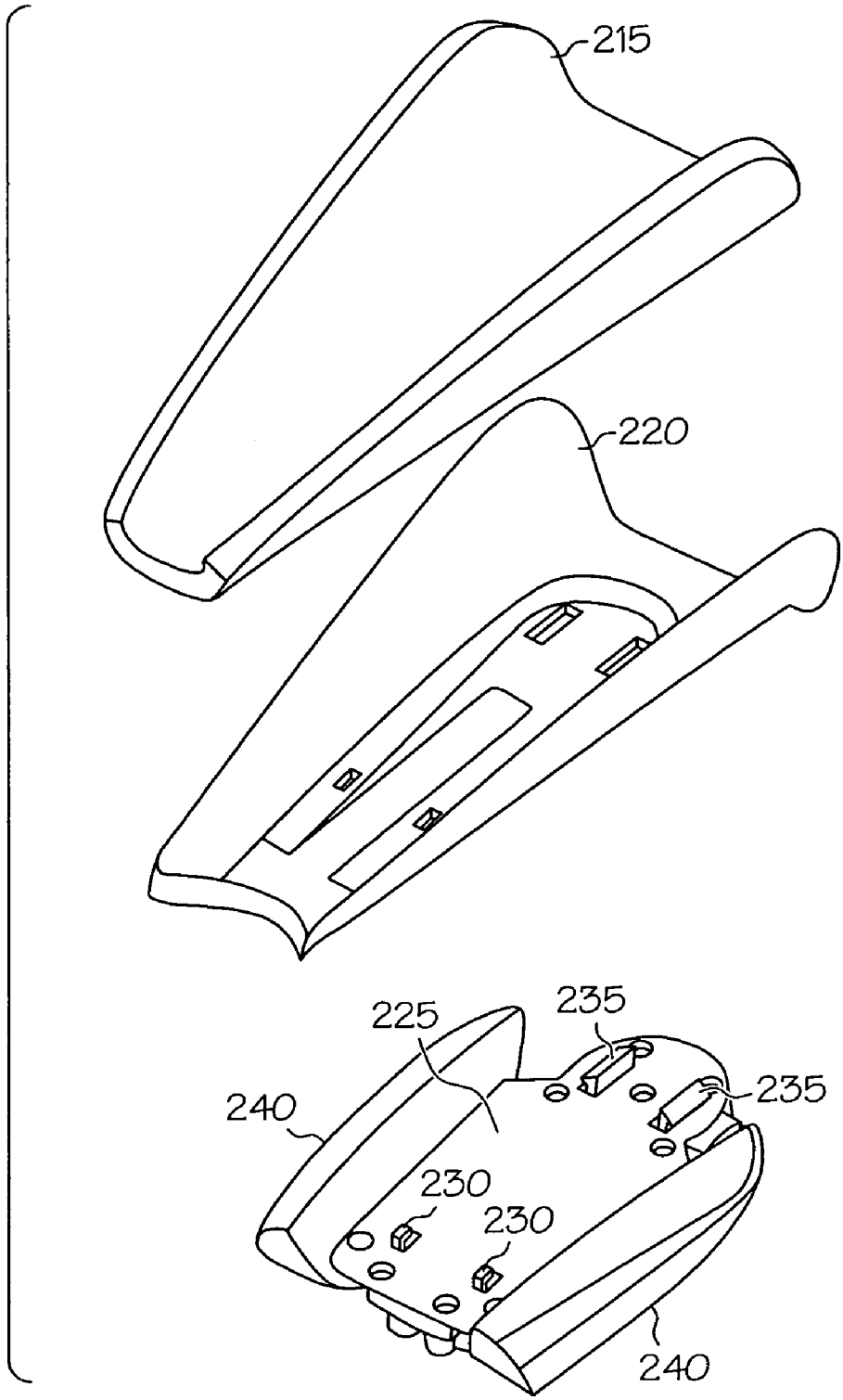
FIG. 12 illustrates a limb cradle assembly in accordance with an aspect of the present invention.

Turning now to FIG. 12, an example of a limb cradle assembly is shown in accordance with an aspect of the present invention. The limb cradle assembly comprises a top portion 215 and a bottom portion 220. The top portion 215 defines an area for receiving the limb of the patient. The bottom portion 220 is coupled to and provides support for the top portion 215 and further includes an area for attachment to the support apparatus 140. In particular, the bottom portion 220 is secured to a mounting plate 225 that is positioned between the bottom portion 220 of the limb cradle and a top portion of the third joint 200. The mounting plate 225 includes one or more, preferably two, fixed prongs 230 and one or more, preferably two, moveable prongs 235. The moveable prongs 235 are adapted to move inward when corresponding release buttons are depressed to release the limb cradle and allowing it to be discarded, if desired. Each of the moveable prongs 235 includes a sloped lead-in to facilitate coupling of the limb cradle bottom 220 without the need to depress the release buttons. Accordingly, the present invention allows attachment and detachment of the limb cradle to and from the positioning apparatus 140 without breaking a sterile field. In other words, the limb cradle can be pressed down over the prongs 230, 235 to latch the limb cradle in place without the need to touch any of the non-sterile parts underneath the sterile drape 250 (FIG. 6).

Alternatively, the limb cradle can be permanently attached to the third joint 200 and the entire unit, including the limb cradle, is draped with a disposable drape. The mounting plate 225 further includes a handle 240 to facilitate support of the limb in a sterile field while one or more of the joints are being unlocked and/or locked.

The limb can be held in position within the limb cradle by a hook and loop fastener that wraps over the limb. Alternatively, the limb can be held in position with a snap and/or buckle fastener. However, it is to be appreciated that the limb can be held in position in the limb cradle in any suitable manner contemplated to one skilled in the art.

Turning back to FIG. 6, a sterile drape 250 is coupled to the limb cradle 205 and is adapted to shroud the moveable portions (e.g., the first, second, and third joints) of the positioning apparatus 140. The drape 250 includes a weighted ring 255 at a bottom portion of the drape 250 to fall easily over the apparatus 140 during installation of the drape 250. Alternatively, the ring 255 can be a plurality of separate weights to weigh down the drape 250. As discussed above, alternatively, a disposable sterile bag can be draped over a permanent limb cradle. Further, configuration of the drape 250 is such that all of the locking members 210, 195, and 203 are easily accessible by the surgeon and all of the joints 185, 190, and 200 are protected by the drape 250.

As described herein, the surgical positioning apparatus includes a plurality of joints, each coupled to a respective locking member that can be operated independently of each other. Accordingly, the degrees of freedom of the plurality of joints, which are based upon the anatomy of the operative limb, are allowed to selectively lock and unlock to allow natural motion of the limb while still supporting the weight of the limb. Further, as stated above, all of the controls for the joints are accessible from the sterile field. Accordingly, a surgeon can operate the controls with the same hand supporting the limb as opposed to conventional positioning devices, which require the surgeon to operate a control with one hand while supporting the limb with the other hand.

The surgical positioning apparatus of the present invention can be manufactured from commercially available components, machined parts, extrusions and drawn shapes. Examples of suitable material include steel and aluminum, although it is obvious that any of a number of different materials could be substituted. According to one aspect, the sterile disposable cradle is made of molded plastic, such as thermoformed, rotomolded, and/or injection molded plastic. However, it is obvious that any of a number of different materials could be employed in its place. The drape can be constructed of a sterilizable impermeable material.

It is to be appreciated that although aspects of the present invention have been shown and described herein as providing support for the lower extremities, the invention can also be employed to provide support to the upper extremities. Further, the present invention has been described herein with mechanical controls for moving various components of the surgical positioning apparatus. However, it is to be appreciated that one or more of the components can be electrically controlled via a remote control device, or the like.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A surgical positioning apparatus comprising:

a docking member adapted to be placed on a floor adjacent one or more feet of an operating room table;

a base secured to the docking member;

a strut extending upwardly from the base and pivotable relative to the base about a first plurality of axes;

a limb support coupled to the strut and configured to support a patient's limb, the limb support being pivotable relative to the strut about a second plurality of axes, wherein the base includes a pivotable coupling to rotatably support the strut for pivotable movement about the first plurality of axes; and a first locking mechanism for the pivotable coupling to selectively lock the pivotable coupling in a desired position, wherein the first locking mechanism for the pivotable coupling comprises a foot pedal.

2. The surgical positioning apparatus of claim 1, further comprising at least one latch mechanism adapted to secure the base to the docking member.

3. The surgical positioning apparatus of claim 1, wherein the strut provides support for the patient's limb in a vertical direction and the pivotable coupling allows movement of the patient's limb in a horizontal plane.

4. The surgical positioning apparatus of claim 3, wherein the strut comprises a telescoping strut.

5. The surgical positioning apparatus of claim 4, further comprising a second locking mechanism to selectively lock the telescoping strut at a desired height.

6. The surgical positioning apparatus of claim 5, wherein the first locking mechanism and the second locking mechanism can be locked and unlocked independently of each other.

7. The surgical positioning apparatus of claim 5, wherein a remote release for the second locking mechanism is located proximate a limb support location to allow a surgeon to hold the limb support and activate the second locking mechanism substantially simultaneously.

8. The surgical positioning apparatus of claim 4, wherein the telescoping strut includes at least one stored energy device within the strut to provide lifting assistance.

9. The surgical positioning apparatus of claim 1, wherein the limb support is operatively coupled to the strut via a universal joint that is coupled to a top portion of the strut.

10. The surgical positioning apparatus of claim 9, wherein the limb support is coupled to the universal joint via a latching mechanism.

11. The surgical positioning apparatus of claim 9, farther comprising a handle operatively coupled to the limb support, the handle being adapted to facilitate support of the patient's limb in a sterile field during adjustment of the surgical positioning apparatus.

12. The surgical positioning apparatus of claim 1, further comprising a protective drape to protect the surgical positioning apparatus from an operating room environment.

13. The surgical positioning apparatus of claim 12, wherein the protective drape includes a geometry that allows access to controls of the surgical positioning apparatus without breaking a sterile field.

14. The surgical positioning apparatus of claim 12, wherein the protective drape is weighted at a bottom portion of the drape.

15. The surgical positioning apparatus of claim 1, wherein the docking member comprises a sheet of material.

16. The surgical positioning apparatus of claim 1, wherein the docking member is adapted to be placed adjacent one or more feet of the operating room table by being configured for placement beneath the one or more feet of the operating room table.

17. The surgical positioning apparatus of claim 1, wherein the base is detachable from the docking member and re-attachable to a different portion of the docking member.

18. The surgical positioning apparatus of claim 1, wherein the docking member comprises at least one guide which receives a portion of the base.

19. The surgical positioning apparatus of claim 18, wherein the at least one guide comprises a channel that receives a side of the base.

20. A surgical positioning apparatus comprising:

a docking member adapted to be placed on a floor adjacent one or more feet of an operating room table;

a base secured to the docking member;

a strut extending upwardly from the base and pivotable relative to the base about a first plurality of axes; and a limb support coupled to the strut and configured to support a patient's limb, the limb support being pivotable relative to the strut about a second plurality of axes;

wherein the limb support is operatively coupled to the strut via a universal joint that is coupled to a top portion of the strut;

wherein the limb support is coupled to the universal joint via a latching mechanism;

wherein the latching mechanism includes at least two prongs and wherein at least one prong is moveable.

21. The surgical positioning apparatus of claim 20, further comprising at least one release mechanism to bias the at least one moveable prong to a disengaged position.

22. A surgical positioning apparatus comprising:

a docking member adapted to be placed on a floor adjacent one or more feet of an operating room table;

a base secured to the docking member;

a strut extending upwardly from the base and pivotable relative to the base about a first plurality of axes; and a limb support coupled to the strut and configured to support a patient's limb, the limb support being pivotable relative to the strut about a second plurality of axes;

wherein the limb support is operatively coupled to the strut via a universal joint that is coupled to a top portion of the strut;

wherein the limb support is coupled to the universal joint via a latching mechanism;

wherein the latching mechanism includes at least two prongs which correspond with at least two slotted apertures in the limb support.

23. A surgical positioning apparatus comprising:

a base supported adjacent a floor;

a strut extending upwardly from the base;

a first multi-axis joint coupling a bottom portion of the strut to the base and configured to permit the strut to pivot relative to the base about a first plurality of axes;

a limb support to support a limb of a patient;

a second multi-axis joint coupling the limb support to a top portion of the strut and configured to permit the limb support to pivot relative to the strut about a second plurality of axes; and a locking mechanism to selectively lock the first multi-axis joint in a desired position, the locking mechanism comprising a foot pedal.

24. The surgical positioning apparatus of claim 23, wherein the strut comprises a telescoping strut that allows the patient's limb to extend and flex at a joint of the limb.

25. The surgical positioning apparatus of claim 23, wherein the first multi-axis joint allows the patient's limb to swing freely in a side-to-side manner.

26. The surgical positioning apparatus of claim 23, further comprising a docking member coupled to the base to provide support for the surgical positioning apparatus on the floor.

27. The surgical positioning apparatus of claim 23, wherein the first multi-axis joint and the second multi-axis joint can each be selectively locked in multiple positions.

28. The surgical positioning apparatus of claim 23, wherein the second multi-axis joint can be locked in a first degree of freedom and moveable in a second degree of freedom.

29. The surgical positioning apparatus of claim 23, wherein the limb support comprises a leg cradle having a concave upper surface which supports the patient's leg.

30. The surgical positioning apparatus of claim 23, wherein the limb support comprises a limb cradle having a concave upper surface which supports the patient's leg.

31. A surgical positioning apparatus comprising:

a base supported adjacent a floor;

a strut extending upwardly from the base;

a first multi-axis joint coupling a bottom portion of the strut to the base and configured to permit the strut to pivot relative to the base about a first plurality of axes;

a limb support to support a limb of a patient; and a second multi-axis joint coupling the limb support to a top portion of the strut and configured to permit the limb support to pivot relative to the strut about a second plurality of axes, wherein the limb support is operatively coupled to the strut via a latching mechanism, wherein the latching mechanism includes at least two prongs, and wherein at least one prong is moveable so that the limb support can be removed from or attached to the strut without breaking a sterile field in an operating room.

32. The surgical positioning apparatus of claim 31, wherein the second multi-axis joint comprises a universal joint and the latching mechanism is provided on the universal joint.

33. The surgical positioning apparatus of claim 31, wherein the latching mechanism is provided on a mounting plate positioned between the second multi-axis joint and the limb support.

34. The surgical positioning apparatus of claim 31, further comprising at least one release mechanism to disengage the at least one moveable prong from the limb support.

35. The surgical positioning apparatus of claim 34, wherein the limb support can be coupled to the strut without activating the release mechanism.

36. The surgical positioning apparatus of claim 31, further comprising one fixed prong positioned near a first edge portion of a body of the latching mechanism and two moveable prongs positioned near second and third edge portions of the body.

37. The surgical positioning apparatus of claim 31, further comprising two moveable prongs positioned substantially parallel with respect to each other at opposed portions on a body of the latching mechanism and one fixed prong positioned on the body substantially perpendicular with respect to the two moveable prongs.

38. The surgical positioning apparatus of claim 31, wherein the limb support includes at least two slotted apertures which correspond with the at least two prongs of the latching mechanism.

39. The surgical positioning apparatus of claim 31, wherein the latching mechanism is located below the limb support.

40. The surgical positioning apparatus of claim 31, wherein the limb support comprises a limb cradle having a concave upper surface which supports the patient's leg.

* * * * *